US009511334B2

(12) United States Patent
Kral et al.

(10) Patent No.: US 9,511,334 B2
(45) Date of Patent: Dec. 6, 2016

(54) CLAMP FOR A FLUID CONTAINER AND METHOD OF USE THEREOF

(71) Applicant: Burrell Scientific LLC, Pittsburgh, PA (US)

(72) Inventors: Charles Kral, Bethel Park, PA (US); Gary Redpath, West Mifflin, PA (US)

(73) Assignee: Burrell Scientific LLC, Pittsburgh, PA (US)

( * ) Notice: Subject to any disclaimer, the term of this patent is extended or adjusted under 35 U.S.C. 154(b) by 513 days.

(21) Appl. No.: 14/013,251

(22) Filed: Aug. 29, 2013

(65) Prior Publication Data

US 2015/0063056 A1 Mar. 5, 2015

(51) Int. Cl.

| | |
|---|---|
| ***B01F 11/00*** | (2006.01) |
| ***B01F 15/00*** | (2006.01) |
| ***B01L 9/00*** | (2006.01) |

(52) U.S. Cl.

CPC ..... *B01F 15/00746* (2013.01); *B01F 11/0008* (2013.01); *B01F 11/0017* (2013.01); *B01L 9/50* (2013.01); *B01L 2300/123* (2013.01)

(58) Field of Classification Search

CPC ..... A61J 9/06; A61J 9/063; B01F 11/0008; B01F 15/00662

See application file for complete search history.

(56) References Cited

U.S. PATENT DOCUMENTS 499,933 A * 6/1893 Phillips ..... B62C 9/00 24/503
1,855,474 A 4/1932 Crawford
1,855,909 A * 4/1932 Fisher ..... B01F 11/0017 366/211
1,895,156 A * 1/1933 Fisher ..... B01L 9/50 248/122.1
2,202,265 A * 5/1940 Phillips ..... B01L 9/00 248/124.1
2,247,978 A * 7/1941 Van Arkel ..... B01F 11/0031 241/175
2,499,945 A * 3/1950 Burrell ..... B01L 9/50 211/60.1

(Continued)

FOREIGN PATENT DOCUMENTS

EP 0090165 B1 7/1986
EP 0188576 B1 1/1991

(Continued)

*Primary Examiner* — Tony G Soohoo

(74) *Attorney, Agent, or Firm* — The Webb Law Firm

(57) ABSTRACT

Provided herein is a clamp and method of use thereof for agitating, mixing, or shaking a fluid container using a mechanical agitator, such as a hand motion shaker. The clamp includes: at least one grip adapted to attach to at least a portion of a fluid container; at least one base comprising a high friction portion configured to contact a bottom portion of the fluid container; a supporting member extending between the grip and the base; and a mounting structure for connecting the support member to a mechanical agitator. The fluid container may be a flask including an elongated narrow neck portion extending from a bulbous portion, which has a larger inner diameter than the narrow neck portion. A method of clamping a fluid container and an assembly including a clamp and a mechanical agitator are also provided.

13 Claims, 5 Drawing Sheets

(56) References Cited

U.S. PATENT DOCUMENTS

D163,035 S * 4/1951 Goldberg ..... 24/486
2,566,430 A 9/1951 Sobers
2,717,700 A * 9/1955 Gruzensky ..... B01F 11/0008 211/1.51
2,731,696 A * 1/1956 Sutton ..... B01L 9/50 248/316.2
2,846,201 A * 8/1958 Mermelstein ..... B01F 11/0008 248/311.2
D188,624 S * 8/1960 Vixler et al. ..... D8/72
2,970,798 A * 2/1961 Friotchle ..... B01L 9/50 24/335
3,111,296 A * 11/1963 Ludes ..... A61J 9/06 24/507
3,118,653 A 1/1964 Dedoes
3,159,384 A 12/1964 Davis
3,184,222 A 5/1965 Aronowitz et al.
3,306,829 A 2/1967 Patterson et al.
3,398,919 A * 8/1968 Tokar ..... A61J 9/06 248/103
3,400,747 A 9/1968 Genser
3,591,862 A 7/1971 Winston
3,693,941 A 9/1972 Suchy
3,735,964 A * 5/1973 Lorenzen ..... B01F 15/00733 366/211
3,893,813 A * 7/1975 Johnson ..... B01L 9/50 24/504
4,109,319 A 8/1978 Brandt
4,284,603 A 8/1981 Korom
4,389,374 A 6/1983 Sutton et al.
4,673,297 A 6/1987 Siczek et al.
4,747,693 A 5/1988 Kahl
4,759,635 A 7/1988 MacMichael et al.
4,787,591 A * 11/1988 Villacorta ..... B01L 9/50 24/339
4,923,305 A 5/1990 Hawrylenko
4,971,276 A 11/1990 Tannenbaum
5,167,928 A * 12/1992 Kelly ..... B01L 9/00 211/164
5,183,336 A 2/1993 Poltorak et al.
5,326,167 A 7/1994 Ware et al.
5,409,312 A 4/1995 Fletcher
5,558,437 A 9/1996 Rode
5,589,135 A 12/1996 Bossart
5,947,594 A * 9/1999 Dolatli ..... B01F 11/0005 366/110
6,059,446 A 5/2000 Dschida
6,332,705 B1 12/2001 Herz et al.
6,341,889 B1 1/2002 Noda et al.
6,508,582 B2 1/2003 Friedman
6,988,825 B2 1/2006 Coville et al.
7,059,762 B2 6/2006 Yi
7,075,040 B2 7/2006 McFadden et al.
7,152,459 B2 12/2006 Jen
7,357,567 B2 4/2008 Terentiev
7,364,350 B2 4/2008 Coville et al.
7,494,267 B2 2/2009 Ware
7,520,657 B2 4/2009 Andrews et al.
7,621,495 B2 * 11/2009 Young ..... B01L 9/50 24/326
7,845,845 B1 12/2010 Kelly
8,186,870 B2 5/2012 Baumfalk et al.
8,226,291 B2 7/2012 Zamirowski et al.
8,393,781 B2 3/2013 Manera et al.
2003/0203155 A1 10/2003 Kobe et al.

FOREIGN PATENT DOCUMENTS

EP 0679430 B1 5/1999
WO 9116127 A1 10/1991
WO 2005053827 A1 6/2005

* cited by examiner

CLAMP FOR A FLUID CONTAINER AND METHOD OF USE THEREOF

BACKGROUND OF THE INVENTION

Field of the Invention

The invention relates generally to a device and method for agitating or mixing fluid within a container and, more particularly, to a clamp for securing the container to a mechanical agitator or shaker.

Description of the Related Art

Many types of fluid containers for holding and mixing fluid solutions in laboratory settings are known. These containers are used for a variety of applications, including metallurgy, textiles, cosmetics, government and education, food and beverage, chemicals, medical and biological testing. Use of such containers is widespread throughout the clinical, biotechnology, and pharmaceutical industries. Fluid containers are generally formed from a rigid transparent material such as glass or plastic, though containers made of metal are also used for some applications. The containers come in a variety of shapes and sizes depending on the particular use. Test tubes are simple graduated tubular containers for holding a small volume of fluid. Beakers and flasks are used for holding larger fluid volumes. A beaker is a generally cylindrical flat bottomed container. Flasks are available in a variety of shapes and sizes. An Erlenmeyer flask is a generally conical structure having angled sides, a flat bottom, and a narrow open end. Florence and round-bottom flasks have an elongated neck portion and a round bottom having a generally curved base. A volumetric flask is a teardrop-shaped container having an elongated neck portion, bulbous lower portion, and a substantially flat bottom.

In many applications, the contents of the fluid container must be mixed or agitated in a controlled and consistent manner for an extended period of time. Most simply, a user, such as a laboratory technician, student, or researcher, may use a stir rod or similar accessory to slowly stir the fluid solution. The user may also shake the container in an up and down or circular fashion to agitate the fluid contained therein. However, manually stirring or shaking a fluid container for an extended period of time is often tedious, imprecise, and difficult to reproduce, quantify, or document. Accordingly, various mechanical stirring, mixing, and agitating methods have been developed.

One common stirring method uses a metal slug placed in the fluid container. The container and slug contained therein are placed on a magnetized surface. The magnetized surface causes the slug to spin or rotate. Movement of the slug agitates the fluid within the container for continuous and reproducible mixing. However, for certain solutions, it is generally not preferable to place a slug in direct contact with the fluid itself. Therefore, alternative mixing and fluid agitation mechanisms are required.

One such alternative mixing mechanism is an orbital or platform shaker. Such shakers generally comprise a raised platform coupled to an automated driving mechanism. The container is placed on the platform to agitate fluid contained therein. Typically, orbital shakers are used with containers having a wide flat bottom that can sit independently on the moveable platform and will not tip over during agitation. For example, beakers and Erlenmeyer flasks are well-suited for use with a platform shaker. Racks and supports may be placed on the platform so that other containers, such as test tubes, round-bottom flasks, volumetric flasks, and the like can also be used with the shaker.

Hand motion shakers, which replicate a twisting motion of a wrist or arm, are also known. Such hand motion shakers are known by a variety of trade names including Wrist-Action®, Wrist-O-Matic, and Wrist-Motion, and are commercially available from several sources including Burrell Scientific and Fisher Scientific of Pittsburgh, Pa., Boekel Scientific of Feasterville, Pa., and Eberbach Corp. of Ann Arbor, Mich. A hand motion shaker includes a spindle coupled to a drive mechanism. The spindle is driven in a back and forth reciprocating motion that simulates radial movement of the wrist. Various connectors, grippers, clamps, clips, and stands are known for attaching a container to the spindle. For example, grippers can be used to grasp a portion of a beaker or flask to hold it in place as the spindle reciprocates. Racks or stands for holding a portion of a test tube are also known. Similarly, clips may be used to attach a flexible structure, such as a fluid bag, to the spindle. When the hand motion shaker is turned on, the spindle reciprocates in a back and forth motion, causing the container attached thereto to reciprocate back and forth. This motion agitates the fluid contained in the container to facilitate mixing. Some hand motion shakers allow a user to vary the reciprocation speed or range of reciprocation to adapt the agitation for a particular purpose. The reciprocation range is generally less than about 15 degrees.

Beneficially, hand motion shakers provide a continuous and gentle shaking motion that is useful for many laboratory applications. However, a hand motion shaker typically cannot be used with a flask with an elongated neck, such as a volumetric or round bottom flask. As described above, volumetric flasks have narrow elongate necks. The fluid is contained in the wider bulbous portion located below the neck. While grippers for attaching to the neck are known, such grippers are unable to properly brace the flask. Particularly, reciprocating motion creates an alternating bending moment at the contact between the grip and neck portion of the flask that can cause the neck portion of the flask to crack or break.

Therefore, there is a need for an enhanced clamp for use with a hand motion shaker. The clamp should be capable of supporting both the elongate neck portion and fluid containing bulbous portion of the flask. The clamp should be able to be used with a variety of standard sized flasks. The clamp should also be easy to manufacture and easily connected to existing hand motion shakers. Additionally, the clamp should be able to hold multiple flasks for simultaneous mixing using a single hand motion shaker.

SUMMARY OF THE INVENTION

Generally, provided is a clamp and method of use thereof that addresses or overcomes some or all of the deficiencies and drawbacks associated with existing devices and methods for agitating, mixing, or shaking a fluid container.

According to one aspect of the invention, a clamp for a fluid container includes at least one grip adapted to attach to at least a portion of a fluid container, at least one base comprising a high friction portion configured to contact a bottom portion of the fluid container, a supporting member extending between the grip and the base, and a mounting structure for connecting the support member to a mechanical agitator.

In certain embodiments, the high friction portion of the base includes a pad formed from a high friction material. The high friction material may be an elastomeric material. Alternatively, the high friction portion may be integrally formed with the base of the clamp.

In certain configurations, the fluid container is a flask comprising an elongated narrow neck portion extending from a bulbous portion, which has a larger inner diameter than the narrow neck portion. In this configuration, the grip may be configured to attach to the neck portion of the flask, and a bottom of the bulbous portion of the flask may contact the high friction portion of the base. The grip may further include opposing arms configured to contact at least a portion of the narrow neck portion of the flask. The opposing arms may be configured to transition from an open position to a closed position by tightening with a threaded fastener coupled to at least one of the opposing arms.

In certain configurations of the clamp, a vertical distance between the grip and the base is greater than a height of the bulbous portion of the flask. For example, the vertical distance between the grip and base may be at least sufficient to accommodate a bulbous portion of a 500 mL volumetric flask.

In certain configurations, the mechanical agitator is a hand motion shaker comprising at least one reciprocating spindle. In that case, the mounting structure may include a circle clamp configured to receive the spindle of the hand motion shaker and a tightener for tightening the clamp about the spindle. Finally, the clamp may further include a second grip and a second base on an opposite side of the supporting member from the grip and the base, so that the clamp can hold two fluid containers.

According to a further aspect of the invention, a method of clamping a fluid container is provided. The method includes providing a clamp. The clamp may include at least one grip adapted to attach to at least a portion of a fluid container, at least one base comprising a high friction portion configured to contact a bottom portion of the fluid container, a supporting member extending between the grip and the base, and a mounting structure for connecting the support member to a mechanical agitator. The method further includes placing the fluid container on the high friction portion of the base and attaching the grip to a portion of a fluid container.

In certain embodiments, the high friction portion of the base includes a pad formed from a high friction material. The method may further include the step of attaching the clamp to a mechanical agitator. The mechanical agitator may be a hand motion shaker including a rotatable spindle and wherein a mounting structure of the clamp is fixedly connected to the spindle. Finally, the fluid container may be a flask comprising a narrow elongated neck portion extending from a bulbous portion having an inner diameter larger than the inner diameter of the neck portion.

According to a further aspect of the invention, an assembly for agitating a fluid container is provided. The assembly includes a mechanical agitator including a drive mechanism coupled to a spindle for rotating the spindle in a back and forth motion. The assembly further includes a clamp. The clamp includes at least one grip adapted to attach to at least a portion of the fluid container, at least one base comprising a high friction portion configured to contact a bottom portion of the fluid container, a supporting member extending between the grip and the base, and a mounting structure for connecting the support member to the mechanical agitator. The clamp is fixedly connected to the spindle of the mechanical agitator through the mounting structure. In certain configurations, the high friction portion of the base is a pad formed from a high friction material.

These and other features and characteristics of the present invention, as well as the methods of operation and functions of the related elements of structures and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and the claims, the singular form of "a", "an", and "the" include plural referents unless the context clearly dictates otherwise.

Additional aspects and advantages of the invention will become readily apparent to those skilled in the art upon reference to the provided figures and detailed description of the preferred embodiments. The invention is not limited to any particular preferred embodiments disclosed.

BRIEF DESCRIPTION OF THE DRAWINGS

Some of the advantages and features of the preferred embodiments of the invention have been summarized hereinabove. These embodiments, along with other potential embodiments of the device, will become apparent to those skilled in the art when referencing the following drawings in conjunction with the detailed descriptions as they relate to the figures.

DETAILED DESCRIPTION OF THE PREFERRED EMBODIMENTS

Figure 1:
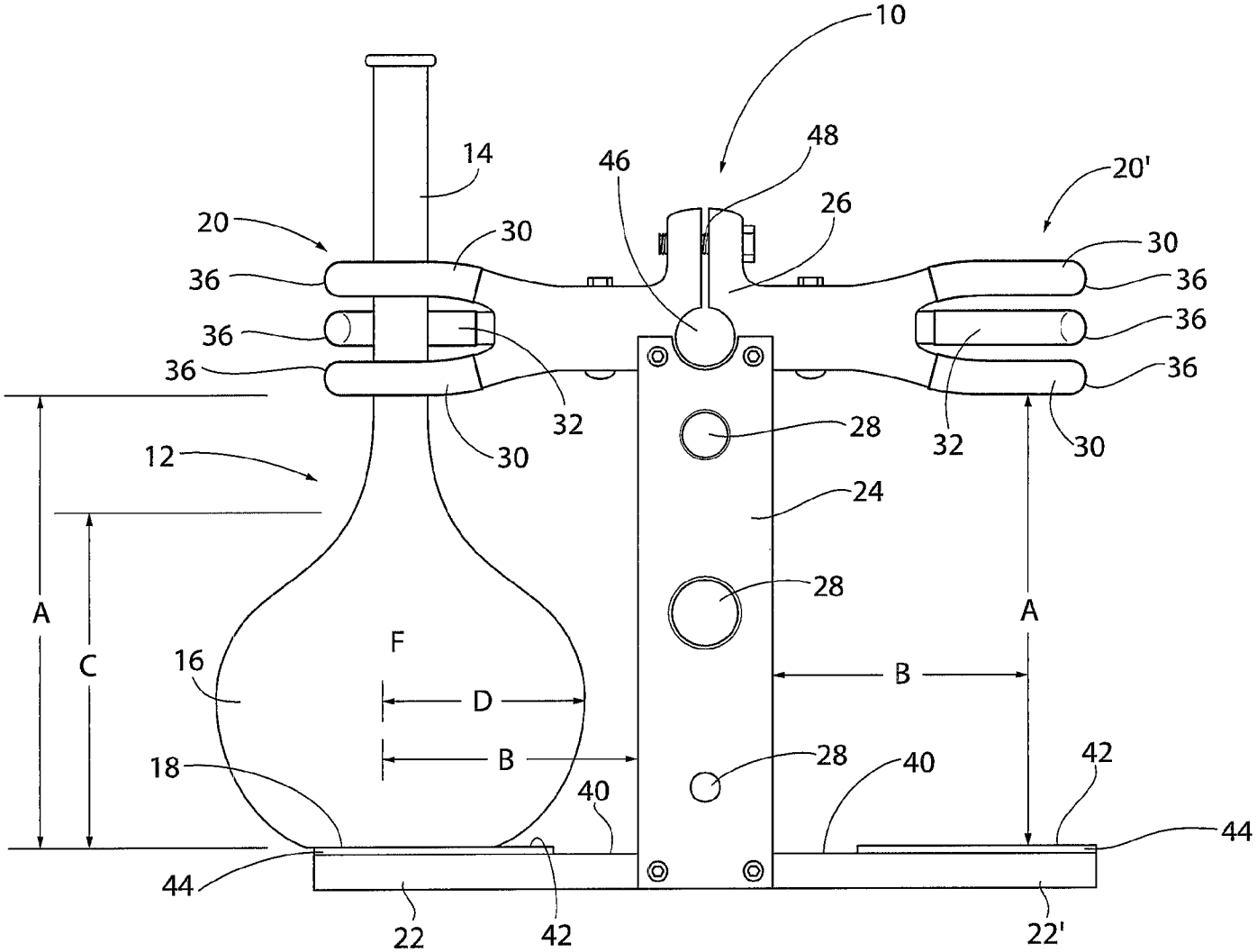
FIG. 1 is a front view of a clamp according to an aspect of the present invention, with a volumetric flask attached thereto.
Figure 2:
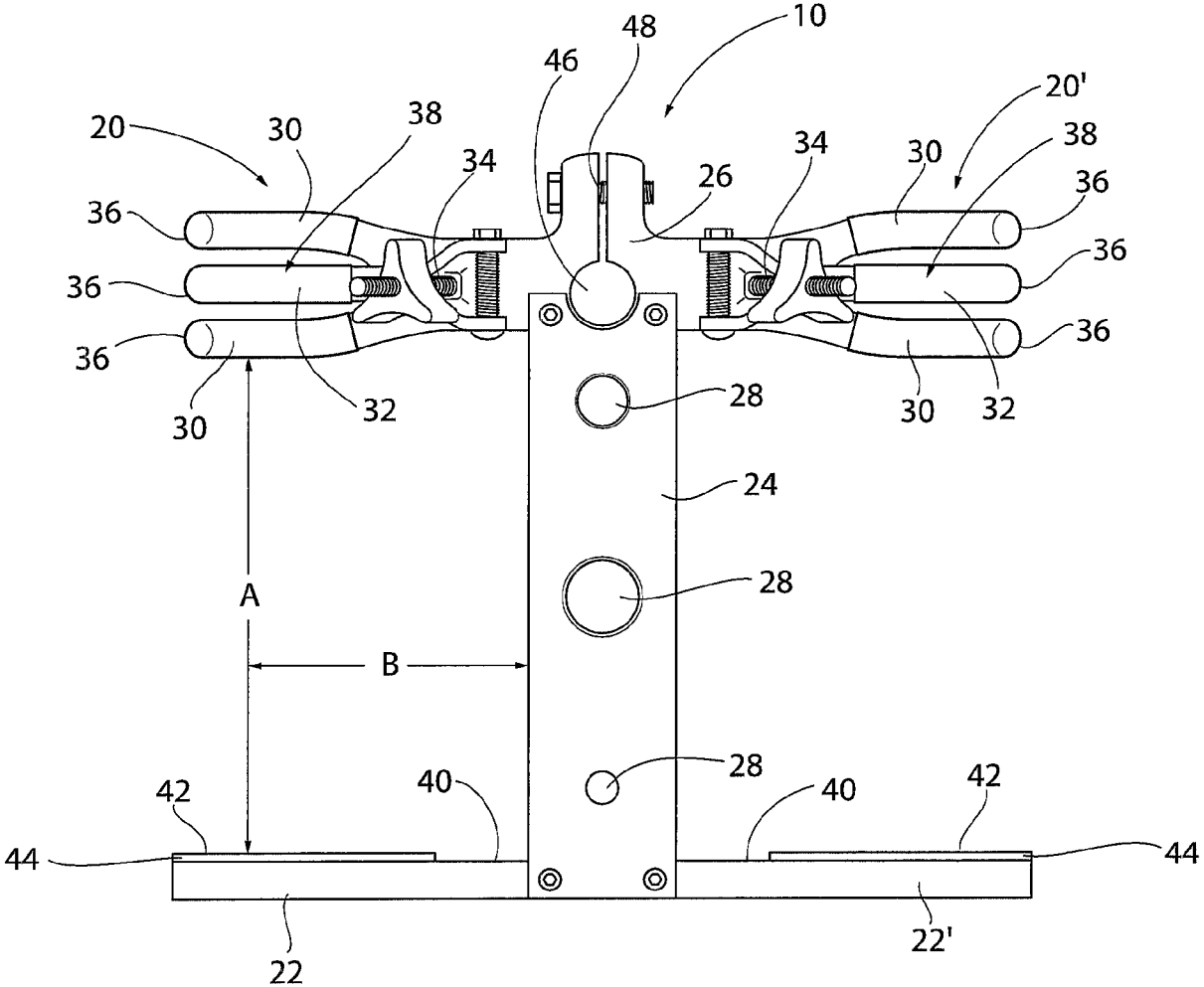
FIG. 2 is a back view of the clamp of FIG. 1.

The illustrations generally show preferred embodiments of the clamp and assembly for agitating a fluid container. While the descriptions present various embodiments of the devices, it should not be interpreted in any way as limiting the invention. Furthermore, modifications, concepts, and applications of the invention's embodiments are to be interpreted by those skilled in the art as being encompassed, but not limited to, the illustrations and descriptions herein.

The following description is provided to enable those skilled in the art to make and use the described embodiments contemplated for carrying out the invention. Various modifications, equivalents, variations, and alternatives, however, will remain readily apparent to those skilled in the art. Any and all such modifications, variations, equivalents, and alternatives are intended to fall within the spirit and scope of the present invention.

Further, for purposes of the description hereinafter, the terms "end", "upper", "lower", "right", "left", "vertical", "horizontal", "top", "bottom", "lateral", "longitudinal" and derivatives thereof shall relate to the invention as it is oriented in the drawing figures. The term "proximal" refers to the direction toward the center or central region of the device. The term "distal" refers to the outward direction extending away from the central region of the device. However, it is to be understood that the invention may assume various alternative variations and step sequences, except where expressly specified to the contrary. It is also to be understood that the specific devices and processes illustrated in the attached drawings, and described in the following specification, are simply exemplary embodiments of the invention. Hence, specific dimensions and other physical characteristics related to the embodiments disclosed herein are not to be considered as limiting. For the purpose of facilitating understanding of the invention, the accompanying drawings and description illustrate preferred embodiments thereof, from which the invention, various embodiments of its structures, construction and method of operation, and many advantages may be understood and appreciated.

Provided herein is a clamp 10 for attaching a fluid container to a mechanical agitator (shown in FIGS. 5 and 6), such as a hand motion shaker. Movement of the fluid container agitates fluid F contained in the container for effective mixing. The fluid F may be a solution, mixture, or slurry containing at least one liquid component. Advantageously, the mechanical agitator provides a continuous, consistent, and easily quantifiable and reproducible motion for controlled mixing of the fluid contained therein. The fluid container may be any sort of container for a medical or laboratory use. For example, the fluid container may be a flexible bag, such as an infusion bag, as well as plastic or glassware containers, including, but not limited to, flasks, beakers, or test tubes. With reference to FIG. 1, in a preferred and non-limiting embodiment, the fluid container is a volumetric flask 12 having a narrow elongate neck portion 14 extending from a bulbous bottom portion 16. The flask 12 may be teardrop-shaped and has a substantially flat bottom 18 for placement on a corresponding flat surface of the clamp 10. Standard sizes for laboratory volumetric flasks are about 500 mL and about 1000 mL. While hereinafter the fluid container is described as a flask 12, it is understood that any of the above-described fluid containers may also be used with the clamp 10, within the scope of the present invention.

Figure 3:
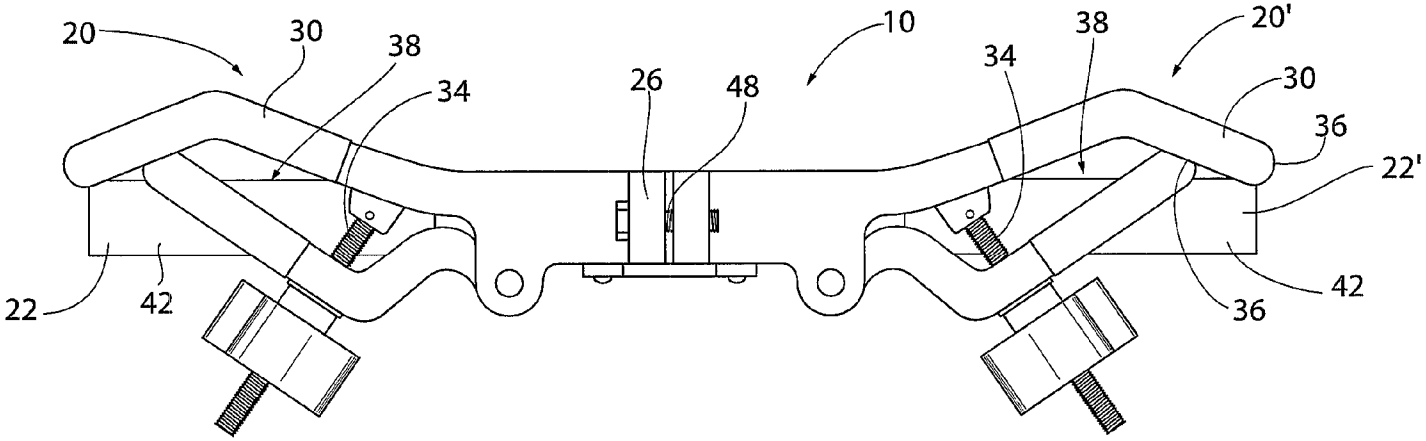
FIG. 3 is top view of the clamp of FIG. 1 in a closed position.
Figure 4:
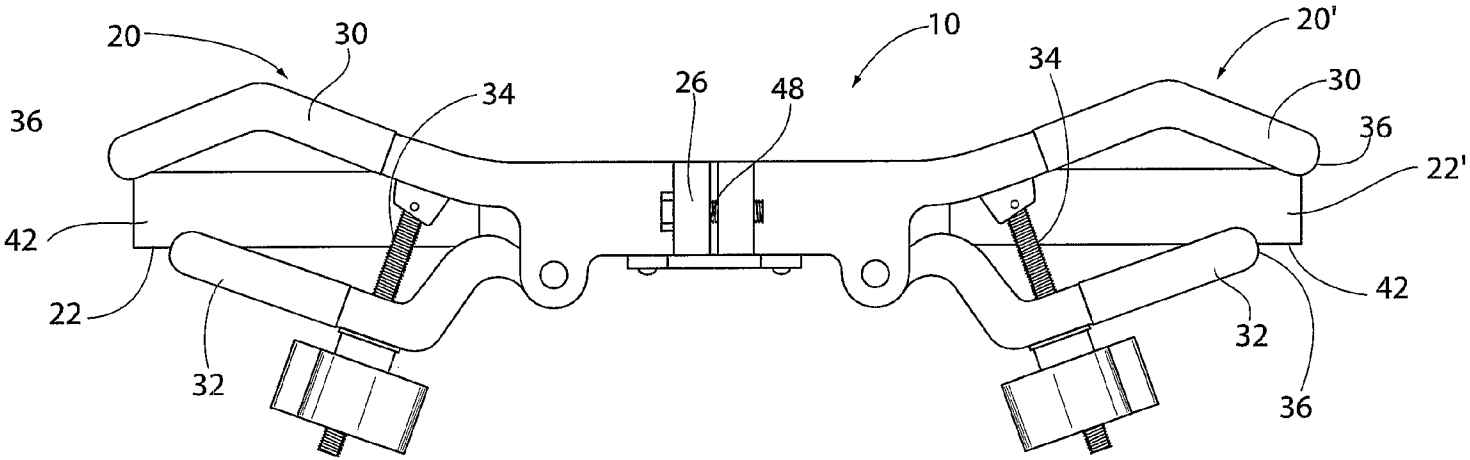
FIG. 4 is a top view of the clamp of FIG. 1 in an open position.
Figure 5:
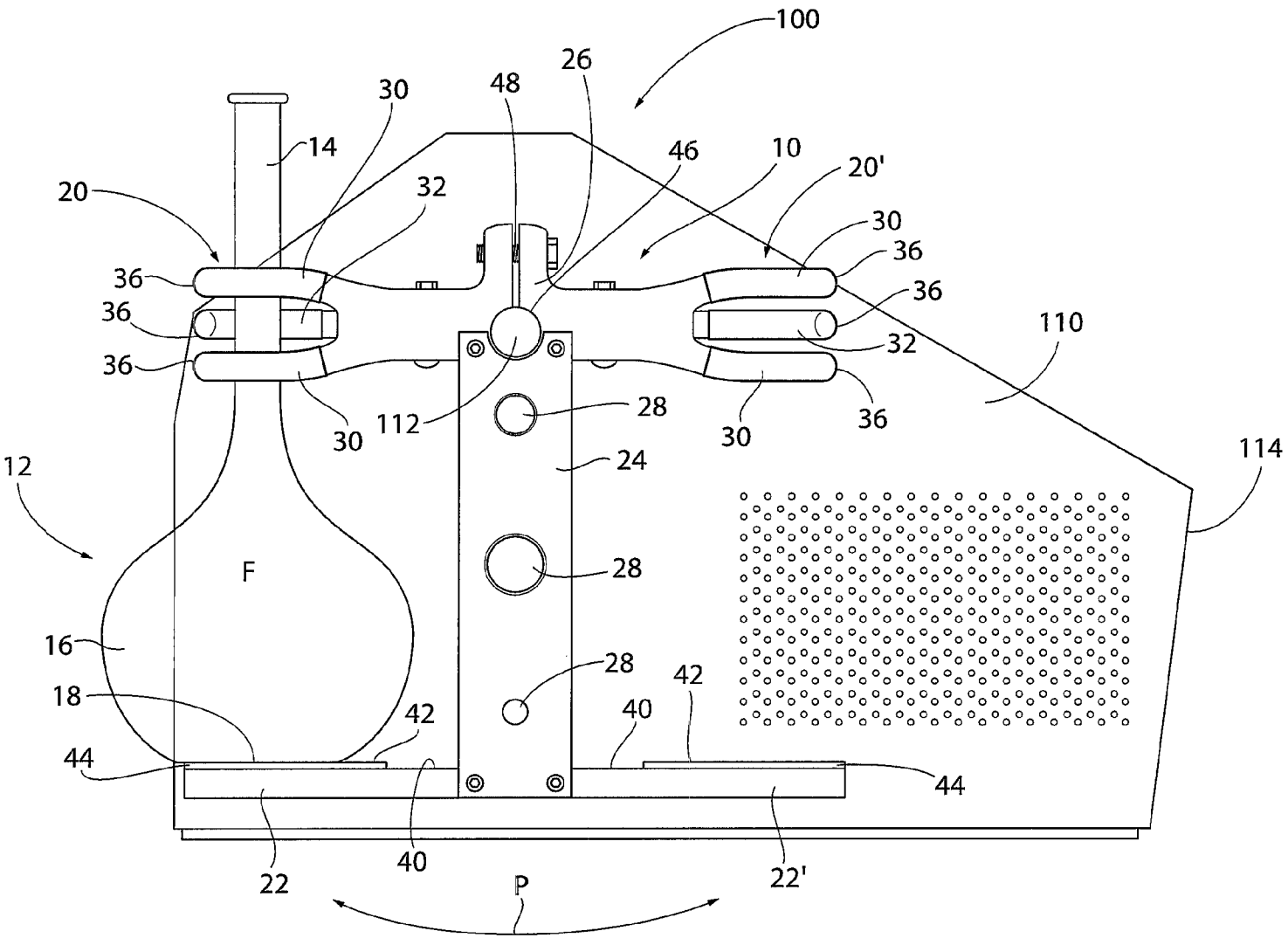
FIG. 5 is a front view of an assembly including the clamp of FIG. 1 attached to a mechanical shaker apparatus, according to an aspect of the invention.
Figure 6:
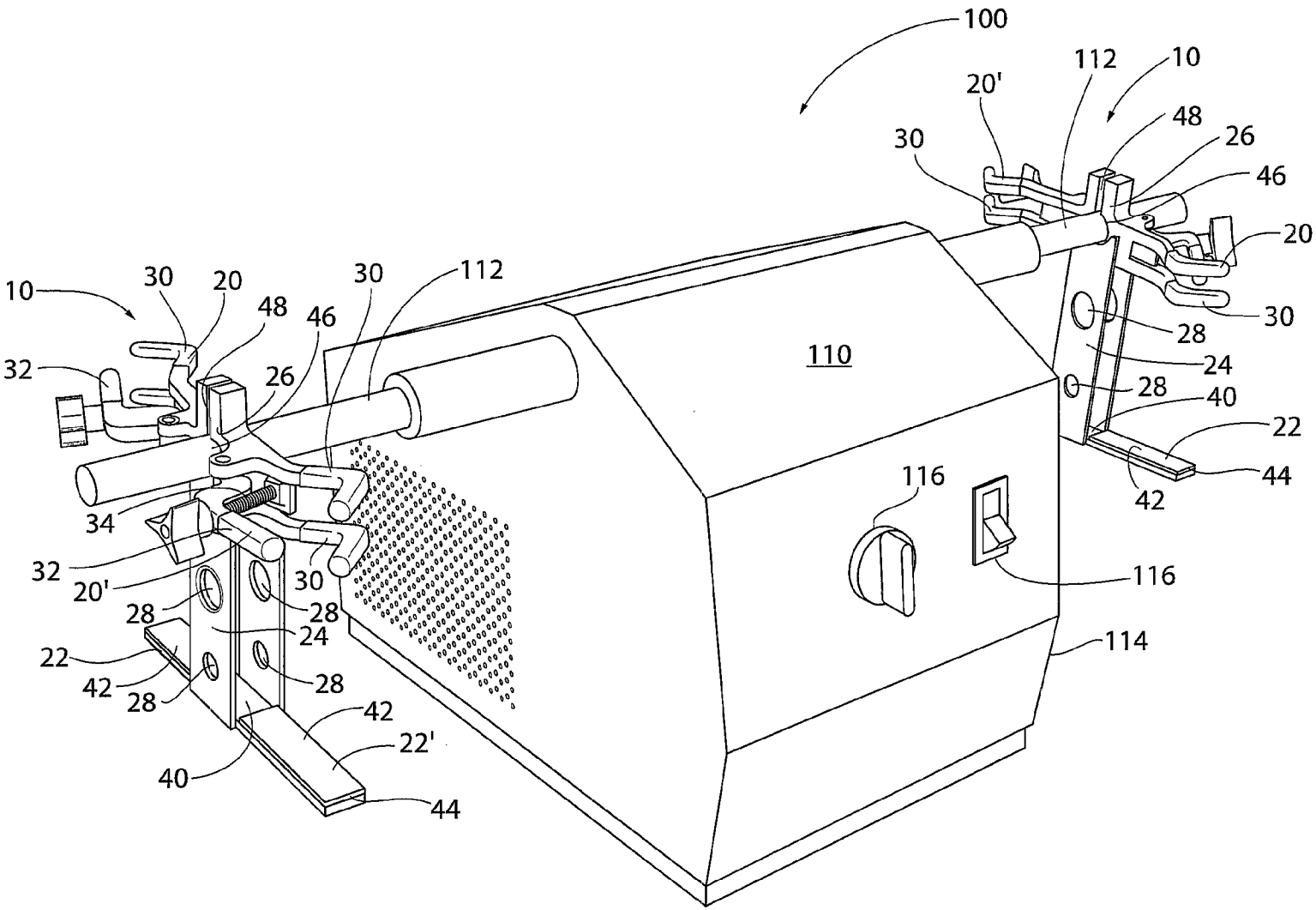
FIG. 6 is a perspective view of the assembly of FIG. 5.

With reference to FIGS. 1-4, the clamp 10 includes at least one grip 20, at least one base 22, a supporting member 24 connected between the grip 20 and the base 22 such that the grip 20 and the base 22 move in unison, and a mounting structure 26 for connecting the clamp 10 to a mechanical agitator (shown in FIGS. 5 and 6). In certain embodiments, the clamp 10 includes a grip 20 and base 22 positioned on one side of the supporting member 24 and another grip 20' and base 22' on an opposite side of the supporting member 24, so that a single clamp 10 can hold two flasks 12. The clamp 10 may be formed from any suitable material having sufficient structural integrity to support the weight of at least one filled or partially filled fluid container. For example, the material may be a metal, hard plastic, ceramic, or any combination thereof. The supporting member 24 may be any suitable supporting structure, including a bracket, brace, or web. Additionally, the supporting member 24 may have a variety of shapes or configurations to simplify manufacturing or reduce weight. For example, the supporting member may include cut out portions 28 to reduce the overall weight and material required to form the clamp 10. The grip 20 and base 22 may be integrally formed with the supporting member 24 or may be separable elements connected to the supporting member 24 by any known connection, including, but not limited to, mechanical fasteners, welded supports, or commercially available adhesives.

The grip 20 is configured to attach to at least a portion of the flask 12 and to support the flask 12 during agitation. In certain embodiments, the grip 20 is tightened about the elongated neck portion 14 of the flask 12 to form a weight-bearing connection therewith. The grip 20 may include any sort of gripping mechanism, as is known in the art, including, but not limited to, an o-ring that can be tightened against a portion of the flask, various moveable locking arms, or a biased support member, such as a u-clamp, that can be positioned to receive the portion of the flask and that returns to an initial biased position to press against the flask 12 to hold it in place.

The grip 20 may include opposing arms, such as stationary arms 30 and moveable arms 32, that can be tightened together to hold the flask 12 in place. The arms 30, 32 may be covered with a high friction and cushioning material such as a synthetic elastomeric material or natural rubber to improve the connection between the arms 30, 32 and the flask 12 and to prevent the arms from scratching, chipping, or otherwise damaging the flask. The arms 30, 32 may be bent to accommodate the curvature of the flask 12. In one embodiment, as shown in FIGS. 1-4, the grip 20 includes a pair of stationary arms 30 on one side of the grip 20 and a single moveable arm 32 on the opposing side of the grip 20. The moveable arm 32 is transitionable from an open position to a closed position. In the open position, as depicted in FIG. 4, the neck portion 14 of the flask 12 can be placed in the grip 20. The moveable arm 32 is transitioned to the closed position by tightening a fastener 34, such as a screw member, to bring the moveable arm 32 toward the stationary arms 30. In the closed position, as depicted in FIG. 3, a distal end 36 of the moveable arm 32 overlaps opposing distal ends 36 of the stationary arms 30. Thus, in the closed position, the arms 30, 32 form an enclosed area 38 for holding the neck portion 14 of the flask 12.

With continued reference to FIGS. 1-4, the base 22 may be a substantially straight member extending from the supporting member 24 and having a flat surface 40 that faces the grip 20. While there is no particularly restriction on the length of the base 22, in a preferred embodiment, the grip 20 and base 22 extend about the same distance from the supporting member 24. Thus, the flat bottom 18 of the flask 12 rests against the base 22, and part of the bulbous portion 16 of the flask 12 extends beyond the base 22.

At least a portion of the flat surface 40 of the base 22 is a high friction surface. When the flask 12 is attached to the clamp 10, the substantially flat bottom 18 of the flask 12 rests against the high friction surface of the base 22. The high friction surface is sufficient to prevent the bottom 18 of the flask 12 from slipping, sliding, or otherwise coming out of contact with the base 22, when the clamp 10 is being moved by the mechanical agitator. The high friction surface may be integrally formed with the base 22, such as by machining or molding a textured pattern to at least a portion of the base 22. Alternatively, as in the embodiment of the clamp 10 depicted in FIGS. 1-4, the high friction surface is a pad 42. The pad 42 is formed from a high friction material, such as a rubberized material, synthetic elastomeric material, or a fabric formed from rigid or textured material. The pad 42 may also include a high friction, adhesive, or textured coating to further improve the connection between the bottom 18 of the flask 12 and the pad 42. Advantageously, the pad 42 may also include cushioning 44 for forming a barrier between the bottom 18 of the flask 12 and the flat surface 40 of the base 22. The cushioning 44 protects the bottom 18 of the flask 12 from breaking, chipping, or being scratched as it is pressed against the base 22.

A vertical distance A between the grip 20 and the base 22 is selected based on the size of the volumetric flask 12 to be attached thereto. More specifically, the distance A between the grip 20 and base 22 corresponds to the height C of the bulbous portion 16 of the flask 12, so that, when attached to the clamp 10, the bulbous portion 16 of the flask 12 sits between the grip 20 and the base 22. There must also be a sufficient horizontal distance B between the grip 20 and the supporting member 24 to accommodate the wider inner diameter D of the bulbous portion 16 of the flask 12. It will also be appreciated that at least a portion of the clamp 10 may be adjustable, so that the clamp 10 can be used with a variety of different sized flasks 12 or different types of fluid containers. Alternatively, the clamp 10 may be designed for a specific standard sized volumetric flask or fluid container.

With continued reference to FIGS. 1-4, the clamp 10 further includes the mounting structure 26 for connecting the clamp 10 to the mechanical agitator. The mounting structure 26 may be a circle clamp 46 extending through the supporting member 24, configured to receive a spindle (shown in FIGS. 5 and 6), piston, or similar moveable structure of the mechanical agitator. The circle clamp 46 may include a tightener 48 or fastener for tightening the circle clamp 46 against the spindle or piston of the agitator. The engagement between the spindle or piston and mounting structure 26 may be a fixed engagement, such that any motion of the piston or spindle in the rotational direction is transferred directly to the clamp 10 and flask 12 attached thereto. The mounting structure 26 may also be configured so that movement of the piston or spindle in other directions, such as the vertical direction (up and down) or the transverse direction (i.e., in and out of the actuator or shaker), is also transferred directly to the attached clamp 10.

With reference to FIGS. 5 and 6, an assembly 100, including a clamp 10 and a mechanical agitator 110, is depicted. The mechanical agitator 110 is a hand motion shaker having at least one rotatable spindle 112 extending from a housing 114 of the device. A drive mechanism (not shown) is enclosed within the housing 114 and coupled to the spindle 112. The spindle 112 is configured for at least one of reciprocating (back and forth), vertical (up and down), or transverse (in and out) motion. For example, the clamp 10 may reciprocate back and forth along path P, as depicted in FIG. 5. While path P may be any suitable range for the desired application, it is generally between 0 and 15 degrees. The agitator 110 may include various controls 116 for altering the agitation speed or the range of reciprocating motion of the spindle 112. As will be appreciated by one having ordinary skill in the art, the agitator 110 may also include numerous other control features, such as a timer, automatic shut-off, or intermittent agitation to further tailor the agitation provided by the shaker for a particular application. Additionally, the agitator 110 may include multiple spindles 112 that rotate either independently or in conjunction with one another. In addition, multiple clamps 10 may be attached to a single spindle 112, further increasing the number of flasks 12 that can be agitated using a single agitator 110.

The clamp 10 is fixedly engaged to the spindle 112 such that motion of the spindle 112 is transferred to the clamp 10. As described above, the clamp 10 includes at least one grip 20, at least one base 22, a supporting member 24 connected therebetween, and a mounting structure 26. A fluid container such as a volumetric flask 12 is attached to the clamp 10. For example, an elongated narrow neck portion 14 of the flask 12 may be attached to the grip 20. A substantially flat bottom portion 18 of the flask 12 may rest against the base 22. The base 22 includes a high friction surface, such as an elastomeric pad 42, which prevents the bottom 18 of the flask 12 from slipping or sliding from the base 22 during agitation of the flask 12 with the mechanical agitator 110. As described above, supporting both the bottom 18 and neck portion 14 of the flask 12 with the clamp 10 prevents the neck portion 14 from cracking or breaking during agitation.

In use, a user, such as a laboratory technician, medical technician, student, or researcher, attaches the clamp 10 to the spindle 112 of the mechanical agitator 110. The user then fills a fluid container, such as a volumetric flask 12, with a fluid F to be agitated. The flask 12 is attached to the clamp 10. More specifically, the user opens the grip 20 of the clamp 10 by loosening a fastener 34 attached thereto. The user then places the flask 12 in the clamp 10, such that a bottom 18 of the flask 12 rests against the high friction portion of the base 22 of the clamp 10. The user then tightens the fastener 34 to secure the grip 20 about another portion of the flask 12, such as the elongated narrow neck portion 14. In this way, the flask 12 is effectively secured to the clamp 10. The user then activates the mechanical agitator 110 using the controls 116, causing the clamp 10 to reciprocate back and forth along path P, as depicted in FIG. 5. Movement of the clamp 10 and flask 12 agitates the fluid F contained within the flask 12 for effective mixing. Once mixing is complete, the user may stop the mechanical agitator 110 and remove the flask 12 from the clamp 10. It is noted that multiple flasks 12 may be agitated at one time using the same mechanical agitator 110. For example, a single clamp 10 may be configured to hold two or more flasks 12. Furthermore, as described above, multiple clamps 10 may be connected to a single agitator 110 for simultaneous agitation of multiple flasks 12. As will be appreciated by one having ordinary skill in the art, the multiple clamps 10 may be adapted for use with different sized flasks 12 or different types of fluid containers so that multiple sizes or types of containers may be agitated simultaneously.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof. Further, although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims. For example, it is to be understood that the present invention contemplates that, to the extent possible, one or more features of any embodiment can be combined with one or more features of any other embodiment.

What is claimed is:

1. A clamp for a fluid container, wherein the fluid container is a flask comprising an elongated narrow neck portion extending from a bulbous portion, which has a larger inner diameter than the narrow neck portion; the clamp comprising:

a first grip adapted to attach to the neck portion of the flask and retain the fluid container in three orthogonal directions;

a first base comprising a high friction portion configured to contact a bottom portion of the fluid container;

a supporting member extending between the first grip and the first base such that the first grip and the first base move in unison;

a mounting structure for connecting the support member to a mechanical agitator, wherein a bottom of the bulbous portion of the flask contacts the high friction portion of the first base;

wherein the high friction portion of each base comprises a pad formed from a high friction material; and further comprising a second grip and a second base extending from an opposite side of the supporting member from the first grip and the first base substantially identical to the first grip and the first base, so that the clamp is adapted to simultaneously hold two fluid containers.

2. The clamp of claim 1, wherein the high friction material is an elastomeric material.

3. The clamp of claim 1, wherein the high friction portion is integrally formed with the each base.

4. The clamp of claim 1, wherein each of the first grip and the second grip comprises opposing arms configured to contact at least a portion of the narrow neck portion of the flask.

5. The clamp of claim 4, wherein the opposing arms are transitionable from an open position to a closed position by tightening with a threaded fastener coupled to at least one of the opposing arms.

6. The clamp of claim 1, wherein a vertical distance between the grip and the base is greater than or equal to a height of the bulbous portion of the flask.

7. The clamp of claim 6, wherein the vertical distance between the grip and base is at least sufficient to accommodate a bulbous portion of a 500 mL volumetric flask.

8. The clamp of claim 1, wherein the mechanical agitator is a hand motion shaker comprising at least one reciprocating spindle.

9. The clamp of claim 8, wherein the mounting structure comprises a circle clamp configured to receive the spindle of the hand motion shaker and a tightener for tightening the circle clamp about the spindle.

10. A method of clamping fluid containers, wherein each fluid container is a flask comprising an elongated narrow neck portion extending from a bulbous portion, which has a larger inner diameter than the narrow neck portion, the method comprising:

providing a clamp comprising:

a first grip adapted to attach to the neck portion of the flask and retain the fluid container in three orthogonal directions, a first base comprising a high friction portion configured to contact a bottom portion of the fluid container, and a supporting member extending between the first grip and the first base such that the first grip and the first base move in unison;

placing the fluid container on the high friction portion of the first base; and attaching the grip to a portion of a fluid container;

wherein a bottom of the bulbous portion of the flask contacts the high friction portion of the first base;

wherein the high friction portion of each base comprises a pad formed from a high friction material; and further providing a second grip and a second base extending from an opposite side of the supporting member from the first grip and the first base, wherein the second grip and the second base operate in an identical fashion to that of the first grip and the first base so that the clamp simultaneously holds two fluid containers.

11. The method of claim 10, further comprising attaching the clamp to a mechanical agitator.

12. The method of claim 11, wherein the mechanical agitator is a hand motion shaker comprising a reciprocating spindle having a range of reciprocation that prevents the flask from becoming inverted and wherein a mounting structure of the clamp is fixedly connected to the spindle.

13. An assembly for agitating a fluid container, wherein the fluid container is a flask comprising an elongated narrow neck portion extending from a bulbous portion which has a larger inner diameter than the narrow neck portion, the assembly comprising:

a hand motion mechanical agitator comprising a reciprocating spindle moveable in a back and forth motion within a range that prevents the flask from becoming inverted; and a clamp comprising:

at least one grip adapted to attach to at least a portion of the fluid container and retain the fluid container in three orthogonal directions, at least one base comprising a high friction portion configured to contact a bottom portion of the fluid container, a supporting member extending between the grip and the base such that the grip and the base move in unison, and a mounting structure for connecting the support member to the mechanical agitator, wherein the clamp is fixedly connected to the spindle of the mechanical agitator through the mounting structure, wherein the grip is configured to attach to the neck portion of the flask and wherein a bottom of the bulbous portion of the flask contacts the high friction portion of the base; and wherein the high friction portion of the base is a pad formed from a high friction material.

* * * * *